US007591273B2

(12) United States Patent
Holley, Jr.

(10) Patent No.: US 7,591,273 B2
(45) Date of Patent: Sep. 22, 2009

(54) METHOD AND APPARATUS FOR CLEANING FLOW CONTROL ELEMENTS

(75) Inventor: James W. Holley, Jr., Colorado Springs, CO (US)

(73) Assignee: Medela Holding AG, Baar (CH)

( * ) Notice: Subject to any disclaimer, the term of this patent is extended or adjusted under 35 U.S.C. 154(b) by 763 days.

(21) Appl. No.: 11/131,753

(22) Filed: May 17, 2005

(65) Prior Publication Data

US 2006/0260651 A1 Nov. 23, 2006

(51) Int. Cl.
*B08B 3/02* (2006.01)

(52) U.S. Cl. ..... 134/166 R; 134/168 R

(58) Field of Classification Search ..... 136/166 R, 136/168 R

See application file for complete search history.

(56) References Cited

U.S. PATENT DOCUMENTS 2,039,177 A * 4/1936 Mackenzie ..... 433/92
2,137,660 A * 11/1938 Welke ..... 134/169 A
2,927,717 A * 3/1960 McDermott ..... 222/213
3,447,548 A * 6/1969 Perkins ..... 134/169 A
3,618,846 A * 11/1971 Poli ..... 228/52
3,833,154 A * 9/1974 Markowitz ..... 222/212
3,850,346 A * 11/1974 Richardson et al. ..... 222/145.7
4,469,250 A * 9/1984 Evezich ..... 222/83.5
4,696,415 A * 9/1987 Meshberg ..... 222/82
4,925,128 A * 5/1990 Brody ..... 222/211
5,178,300 A * 1/1993 Haviv et al. ..... 222/95

FOREIGN PATENT DOCUMENTS

GB 2 067 517 * 7/1981

* cited by examiner

*Primary Examiner*—Frankie L Stinson
(74) *Attorney, Agent, or Firm*—McDonnell Boehnen Hulbert & Berghoff LLP

(57) ABSTRACT

A mechanism for cleaning a flow control element (e.g., a baby bottle nipple or a child sippy cup flow control valve) that includes a tube-like wall section defining a flow channel, and a substantially flat membrane supported across the flow channel, where the membrane includes multiple pinholes that remain closed to prevent fluid flow under normal atmospheric conditions, and open and to facilitate fluid flow rate through the membrane under an applied pressure differential (e.g., when sucked on by a child). The mechanism includes a tubular flow member including a fixture that is pressed into and secured inside the flow channel by frictional contact, and a pump for pulling and/or pushing a cleaning solution (e.g., soapy water) in the flow channel by way of the tubular flow member, whereby the cleaning solution forces the membrane to repeatedly stretch such that the cleaning solution repeatedly passes through the membrane.

6 Claims, 6 Drawing Sheets

METHOD AND APPARATUS FOR CLEANING FLOW CONTROL ELEMENTS

FIELD OF THE INVENTION

The present invention relates to fluid flow control devices for beverage containers, and more specifically it relates to methods and devices for cleaning "no drip" flow control elements that are utilized in baby bottles and child sippy cups.

RELATED ART

Baby bottles and sippy cups represent two types of beverage containers that utilize flow control devices to control the ingestion of beverage in response to an applied sucking force. Baby bottle assemblies utilize nipples to pass baby formula or milk from the bottle to a child (i.e., infant or toddler) through a flow hole or slit formed in the end of the nipple in response to a sucking force (pressure) applied by the child on the nipple. Sippy cups are a type of spill-resistant container typically made for children that include a cup body and a screw-on or snap-on lid having a drinking spout molded thereon. An inexpensive flow control element, such as a soft rubber or silicone outlet valve that is provided with a normally-closed slit, is often provided on the sippy cup lid to control the flow of liquid through the drinking spout and to prevent leakage when the sippy cup is tipped over when not in use.

A typical conventional method for cleaning baby bottle nipples involves inserting a small brush into nipple cavity and scrubbing the inside surface to remove, for example, dried milk solids. A problem with the use of brushes for this purpose is that such brushes can scratch or otherwise damage the nipple wall next to the flow hole or slit, which can weaken the nipple wall and possibly result in rupture of the nipple. Another problem with the use of brushes is that they do not provide a suitable mechanism for cleaning milk solids that become trapped in the flow hole or slit formed in the end of the nipple, thus allowing these milk solids to accumulate over time and prevent proper operation of the nipple. Similar problems arise when brushes are used to clean the flow control elements utilized in sippy cups.

What is needed is an apparatus and method for cleaning flow control elements (e.g., baby bottle nipples and/or sippy cup flow control elements) that reliably removes deposits from the flow hole/slit without scratching or otherwise damaging the flow control elements.

SUMMARY

The present invention is directed to an apparatus for cleaning a flow control elements (e.g., a baby bottle nipple or a child sippy cup flow control valve) that includes a tubular fixture that is inserted inside and attached to the side wall of the flow control element, and a pump mechanism for forcing cleaning solution (e.g., soapy water) through the flow control element at a high pressure, thus causing the cleaning solution to remove deposits without scratching or otherwise damaging the flow control element.

In accordance with an aspect of the invention, a tip end of the tubular fixture of the cleaning apparatus is tapered and includes a relatively wide end structure that presses against the inside wall of the flow control element when inserted therein, thus securely attaching the tubular fixture to the flow control element during the cleaning process. Alternatively, or in addition, one or more tapered, longitudinal ribs are provided on the outer wall of the tubular fixture that further secure the fixture to the inner inside wall of the flow control element when inserted therein.

In accordance with another aspect of the invention, the pump mechanism is mounted at the base end of the tubular fixture, and facilitates the flow of cleaning solution through the tubular fixture at high pressure. In one embodiment, the pump mechanism includes a plunger that is received inside the tubular fixture, and a handle that is attached to the plunger to facilitate manual reciprocation of the plunger in a longitudinal direction, thus generating the desired cleaning solution flow.

In accordance with another embodiment of the present invention, a method for cleaning a flow control element includes inserting a tip of the tubular member inside the flow control element, and then generating a reciprocating flow inside the flow control element such that cleaning solution is forced through the flow hole(s)/slit(s) provided at the end of the flow control element, thereby removing deposits that may be present inside the flow control element before the cleaning process.

While the present invention provides a beneficial solution to cleaning conventional flow control elements, the invention is particularly useful for cleaning flow control elements including elastic membranes with pinholes, such as those disclosed in co-pending U.S. patent application Ser. No. 10/758,573, which is incorporated herein in its entirety. Such flow control elements include a tube-like wall section defining a flow channel, and a membrane supported in the flow channel such that membrane impedes flow through the flow channel to an external region. The membrane is substantially flat (planar), arranged perpendicular to the flow channel such that a force generated by the applied pressure differential is perpendicular to a plane defined by the non-deformed membrane. In addition, the membrane is formed from a suitable elastomeric material (e.g., soft rubber, thermoplastic elastomer, or silicone) that is punctured to form multiple, substantially round pinholes that remain closed to prevent fluid flow through the membrane and flow channel under normal atmospheric conditions (i.e., while the membrane remains non-deformed), and when subjected to an applied pressure differential (e.g., when sucked on by a child), the membrane stretches (deforms), some or all of the pinholes open to facilitate fluid flow rate through the membrane.

With respect to flow control elements including elastic membranes with pinholes, the present invention is particularly beneficial due to the delicate nature of the thin membrane, which is easily damaged by a standard brush, and because the uniform pressure applied to the membrane by the pump mechanism causes the various pinholes to reliably open to facilitate the cleaning process.

The present invention will be more fully understood in view of the following description and drawings.

DETAILED DESCRIPTION

Figure 1A:
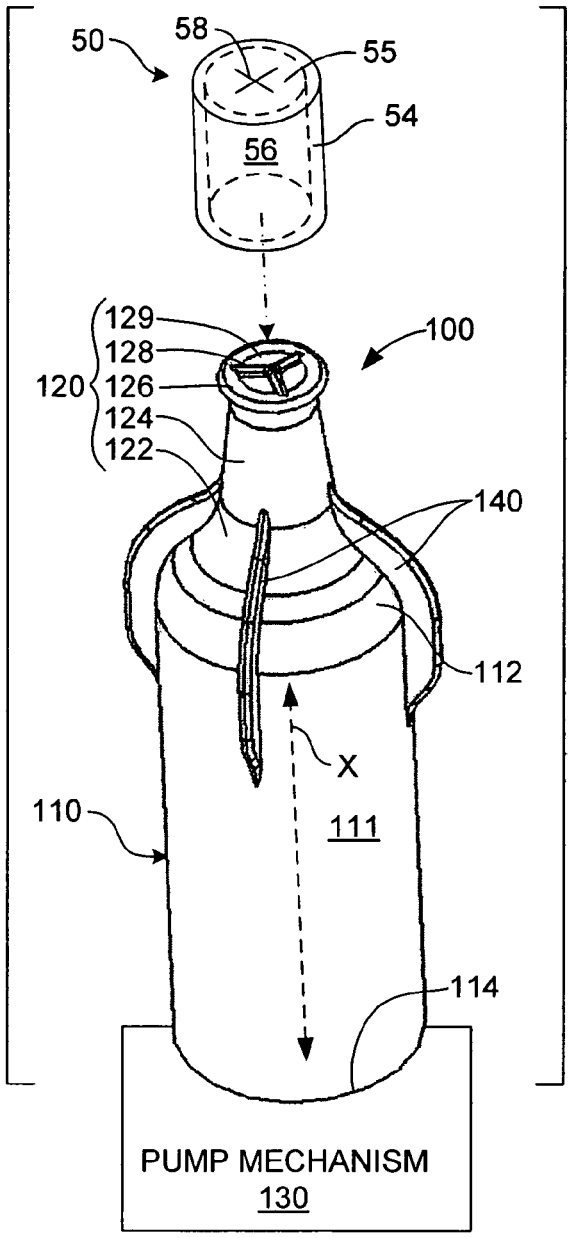
FIGS. 1(A) and 1(B) are perspective views showing a flow control element and a simplified apparatus for cleaning the flow control element in accordance with an embodiment of the present invention.
Figure 1B:
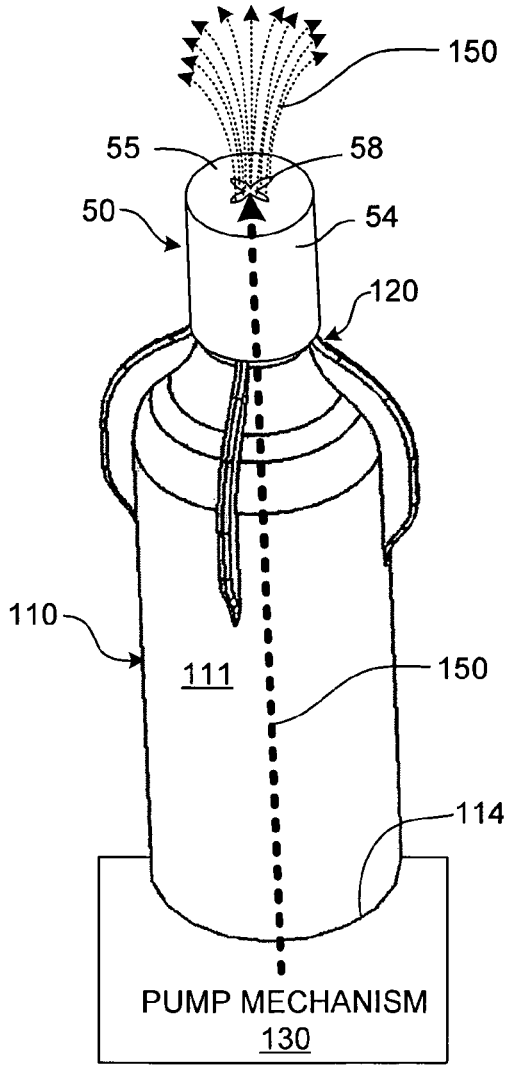

FIGS. 1(A) and 1(B) are perspective views showing a simplified apparatus 100 for cleaning a generalized flow control element 50 in accordance with an embodiment of the present invention. Note that generalized flow control element 50 is intended to represent a wide range of both conventional flow control elements (e.g., baby bottle nipples and sippy cup valves), along with a proprietary membrane-based flow control element, described below, for which the present invention is particularly directed. Each of these flow control elements may be characterized as including a tube-like wall section 54 defining a (first) flow channel 56, and an end section 55 defining an outlet (e.g., hole or slit) 58. During use, suction applied to one side of end section 55 draws a beverage through flow channel 56 and outlet 58. As described above, this use typically results in small quantities of the beverage becoming trapped in the outlet when the suction is terminated, which over time may collect in sufficient quantity to prevent proper operation of outlet 55, or may spoil and produce unhealthy contaminants.

Referring to FIG. 1(A), apparatus generally includes a tubular flow member 110, a tapered fixture 120 fixedly or integrally attached to a first end 112 of tubular flow member 110, and a pump mechanism 130 mounted onto a second end 114 of tubular flow member 110.

Tubular flow member 110 is a plastic pipe-like structure that defines a (second) flow channel 111 extending between first end 112 and a second end 114 in a longitudinal direction indicated by the dashed arrow X. Tubular flow member 110 serves both as a fluid conduit, and as a structural housing that operably connects tapered fixture 120 to pump mechanism 130.

Tapered fixture 120 is integrally molded or otherwise fixedly attached to tubular flow member 110 at first end 112, and has a size selected such that, when tapered fixture 120 is inserted inside tube-like wall section 54 of flow control element 50, tapered fixture 120 becomes frictionally engaged to the inside surface of tube-like wall section 54. In one embodiment, tapered fixture 120 includes a tapered neck section 122 integrally attached to end 112 of tubular flow member 110, a mounting structure 124 integrally formed on the free end of tapered neck section 122, a lip 128 mounted on the free end of mounting structure 124, and a rail structure 129 that is attached to lip 128 and extends over an end opening 129. Tapered neck region 122 includes a relatively wide diameter region extending from upper end 112 of tubular flow member 110, and a relatively narrow diameter region attached to mounting structure 124. Mounting structure 124 is substantially cylindrical for fitting inside flow control element 50, but has a slight taper to facilitate insertion. Lip 128 is a ring-like structure integrally formed on the free end of mounting structure 124, and serves to frictionally engage the inside surface of flow control element 50. Rail structure 129 serves to support end section 55 of flow control element 50, and to keep end section 55 slightly stretched so liquid can flow through the pin holes (or other opening) in either direction. This allows apparatus 100 to suck in soapy water from a sink or other reservoir through end section 55, and then push the soapy water back through end section 55. If end section 55 was completely closed at rest, it would be difficult to suck in the soapy water.

Pump mechanism 130 is connected to tubular flow member 110 at lower end 114, and serves to generate fluid flow in tubular flow section 110 such that a cleaning solution 115 flows through tapered fixture 120 and passes through the outlet 58 of flow control element 50, as indicated in FIG. 1(B). Those skilled in the art will recognize that pump mechanism 130 can take any of several forms, and is therefore depicted using a simple block representation. In various exemplary embodiments, pump 130 may be implemented using a plunger that is actuated using a hand pump, such as that described below with reference to FIG. 12, and a baster-type squeeze ball. Alternatively, other known hand pump mechanisms or electric pump mechanisms may be used.

According to an alternative embodiment of the present invention, one or more longitudinal ribs 140 are integrally formed on the outside surface of tapered figure 120 and flow member 110, and have tapered ends located on mounting structure 124. The purposes of longitudinal ribs 140 are to facilitate mounting flow control element 50 onto tapered fixture 120, and also to facilitate cleaning (scraping) of the inside surface of flow control element 50 by rotating flow control element 50 relative to fixture 120.

As indicated in FIG. 1(B), during use, flow control element 50 is manually mounted over tapered fixture 120, and pump mechanism 130 is actuated to generate a flow of cleaning solution 150 (e.g., soapy water; indicated by dashed line) along flow channel 111 such that cleaning solution 150 flows through tapered fixture 120 and passes through outlet 58. Note that the outer surface of tapered fixture 120 is sized such that, when inserted inside tube-like wall section 54 of flow control element 50, tapered fixture 120 becomes frictionally engaged to the inside surface of tube-like wall section 54. Pump 130 preferably generates sufficient pressure to force open outlet 58, thus producing the jetted-liquid effect illustrated by the dashed arrows shown above flow control element 50 in FIG. 1(B).

While the present invention provides a beneficial solution to cleaning conventional flow control elements, the invention is particularly useful for cleaning flow control elements including elastic membranes with pinholes, such as those disclosed in co-pending U.S. patent application Ser. No. 10/758,573 (cited above), which are described below.

Figure 2:
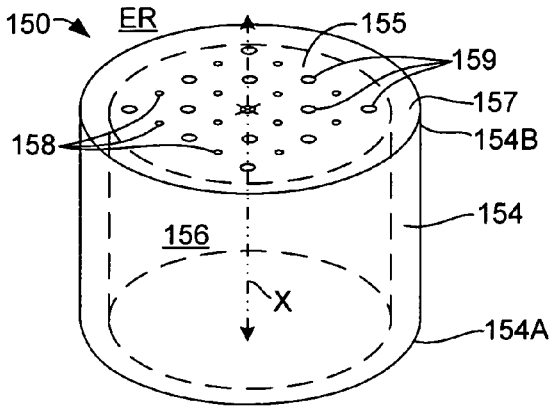
FIG. 2 is a perspective side view showing a flow control element according to a generalized embodiment of the present invention.
Figure 3A:
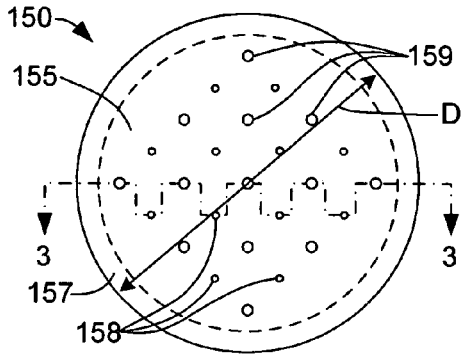
FIGS. 3(A) and 3(B) are top and cross-sectional side views, respectively, showing the flow control element of FIG. 1.
Figure 3B:
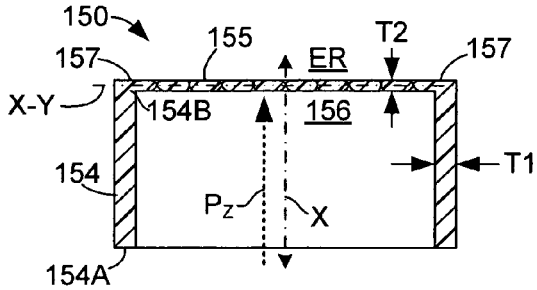

Referring to FIG. 2, membrane-type flow control element 150 generally includes a wall section 154 and a flat membrane 155. FIGS. 3(A) and 3(B) show flow control element 150 in top plan and cross-sectional side views, respectively, where FIG. 3(B) is taken along section line 3-3 of FIG. 3(A).

Wall section 154 is a tube-like structure defining a fluid flow channel 156 that extends generally along a central axis X between a lower (first) end 154A and an upper end 154B of wall section 154. As indicated in FIG. 3(A), in one embodiment wall section 154 has a circular cross section having a diameter D.

Membrane 155 is formed form a relatively elastic material and is connected to wall section 154 such that membrane 155 is disposed across fluid flow channel 156 to impede flow between fluid flow channel 156 and an external region ER (i.e., either from fluid flow channel 156 to external region ER, or from external region ER to fluid flow channel 156). In the disclosed embodiment, membrane 155 has a circular outer perimeter 157 that is secured to wall section 154, elastic membrane 155 is formed from a suitable material (e.g., soft rubber, thermoplastic elastomer, or silicone) having a thickness T1 in the range of 0.01 to 0.1 inches (more particularly, 0.02 to 0.05 inches). According to the present invention, membrane 155 defines a plurality of spaced-apart pinholes 158 and 159 that are formed by puncturing membrane 155 using fine-tipped pins such that when membrane 155 is subjected to normal atmospheric conditions and membrane 155 remains non-deformed, pinholes 158 and 159 remain closed to prevent fluid flow between fluid flow channel 156 and external region ER through membrane 155. As described in additional detail below, pinholes 158 and 159 are also formed such that when membrane 155 is deformed (stretched) in response to an applied pressure differential between fluid flow channel 156 and external region ER, pinholes 158 and 159 open to facilitate fluid flow through membrane 155. Accordingly, pinholes 158 and 159 facilitate adjustable fluid flow through membrane 155 that increases in direct relation to the applied pressure differential, thereby facilitating, for example, a baby bottle nipple that can be used throughout a child's development from infant to toddler.

Figure 4A:
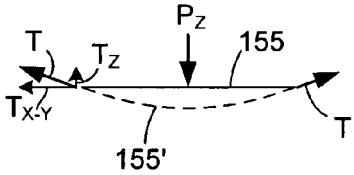
FIGS. 4(A) and 4(B) are simplified diagrams illustrating tensile forces generated in flat and curved membranes.
Figure 4B:
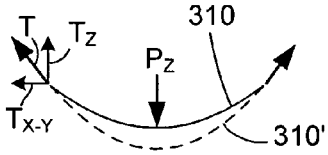

As indicated in FIG. 3(B), membrane 155 is substantially flat (planar) in its relaxed (i.e., non-deformed or unstretched) state, and lies in a plane X-Y that is perpendicular to central axis X defined by wall section 154. Two advantages are provided by making membrane 155 in this manner. A first advantage, which is illustrated by the simplified diagrams shown in FIGS. 4(A) and 4(B), is that a flat membrane is easier to stretch under an applied pressure than a curved membrane. In particular, as depicted in FIG. 4(A), a pressure $P_Z$ applied perpendicular to substantially flat membrane 155 causes membrane 155 stretches (bows downward, as indicated by the dashed membrane 155'). Note that because membrane 155 is substantially flat, virtually all of the resultant tensile force T generated in membrane 155 is directed in the X-Y plane (indicated by component. $T_{X-Y}$), thereby generating little or no component $T_Z$ in the Z-axis direction until the membrane is at least partially stretched. Because the tension component $T_Z$ remains relatively small, planar membrane 155 is stretched (and the pinholes opened) in response to a relatively small applied pressure $P_Z$, thereby facilitating fluid flow through membrane 155 in response to a relatively small sucking force. In contrast, as indicated in FIG. 4(B), a pre-curved membrane 310 generates a significantly larger tensile force component $T_Z$, thereby requiring a substantially larger pressure $P_Z$ to produce even a minimal stretching of membrane 310 from its resting position (e.g., as indicated by deformed membrane 310', shown in FIG. 3(B)). A second advantage to provided by making membrane 155 substantially flat is that, as described below, formation of the pinholes is greatly simplified and facilitated.

Referring to FIG. 3(A), membrane 155 defines a plurality of spaced-apart pinholes 158 and 159 that are arranged in a two-dimensional pattern. The term "spaced-apart" is used to indicate that the pinholes are separated by regions of non-perforated membrane material (i.e., there are no holes, cracks, slits, or other significant structural weaknesses in the membrane material in the regions separating adjacent pinholes). The spacing between pinholes 158 and 159 is selected based on the membrane material such that tearing of the membrane material between adjacent pinholes is avoided under normal operating conditions (i.e., the pinholes are spaced as far apart as is practical). Note that arranging pinholes 158 and 159 in a two-dimensional pattern provides the advantage of balancing the distribution of forces across membrane 155, thereby reducing the chance of tearing of the membrane material.

According to another aspect of the present invention, wall section wall section 154 has a greater rigidity than the membrane 155 such that, when an applied pressure differential is generated between fluid flow channel 156 and external region ER, membrane 155 undergoes a greater amount of deformation than wall section 154. In one embodiment, membrane 155 and wall section 154 are integrally molded from a suitable material (i.e., both hollow structure 154 and elastic membrane 155 are molded in the same molding structure using a single molding material, e.g., silicone, a thermoplastic elastomer, or soft rubber), and the increased rigidity is provided by forming wall section 154 to include a thickness T1 that is greater than the thickness of membrane 155. In an alternative embodiment, wall section 154 may be formed from a relatively rigid material (e.g., a hard plastic), and membrane 155 may be separately formed from a relatively elastic material and then secured to wall member 154.

Referring again to FIGS. 2 and 3(A), membrane 155 is depicted as being secured around its peripheral edge 157 to upper end 154B of wall section 154. Membrane 155 may be alternatively be recessed into flow channel 156 to avoid damage caused, for example, by gumming or chewing on the end of flow control element 150. In yet other alternative embodiments, membrane 155 may located anywhere between lower end 154A and upper end 154B of wall section 1154.

Figure 5A:
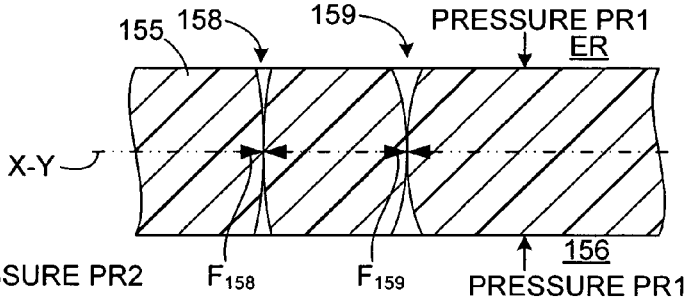
FIGS. 5(A), 5(B) and 5(C) are enlarged cross-sectional side views showing a portion of the membrane of the flow control element of FIG. 1 during operation.
Figure 5B:
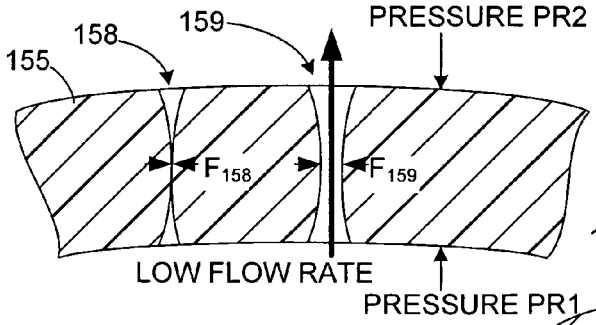
Figure 5C:
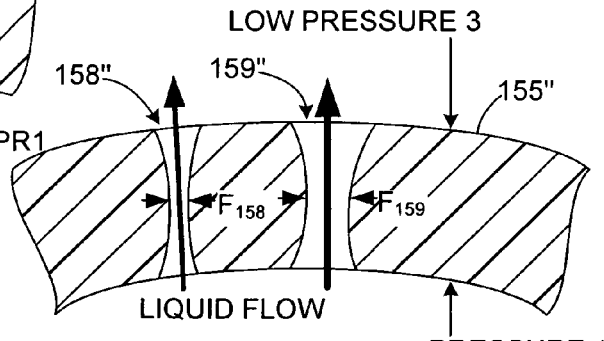

FIGS. 5(A) through 5(C) are enlarged cross-sectional side views depicting pinholes 158 and 159 under normal atmospheric conditions (FIG. 5(A)) and under applied pressure differential conditions (FIGS. 5(B) and 5(C)). Referring to FIG. 5(A), under normal atmospheric conditions (i.e., when a pressure PR1 exists both in fluid flow channel 156 and in external region ER), membrane 155 remains non-deformed (e.g., planar), and pinholes 158 and 159 remain closed to prevent fluid flow between fluid flow channel 156 and the external region ER through membrane 155. In contrast, as indicated in FIG. 5(B), when an applied pressure differential is generated (e.g., pressure PR1 exists in fluid flow channel 156, but a relatively low pressure PR2 is generated in external region ER, e.g., due to sucking), membrane 155 is deformed (i.e., stretched toward external region ER), and at least one of pinholes 158 and 159 is opened to facilitate fluid flow through membrane 155.

According to another embodiment of the present invention, pinholes 158 and 159 are formed, for example, using different sized pins such that when membrane 155 is subjected to a relatively low applied pressure differential, pinholes 158 remain closed and pinholes 159 open to facilitate a relatively low fluid flow rate through membrane 155, and when membrane 155 is subjected to a relatively high applied pressure differential, both pinholes 158 and 159 open to facilitate a relatively high fluid flow rate through membrane 155. As indicated in FIG. 5(A), both holes 158 and 159 remain pinched closed under normal atmospheric conditions due to the elasticity of the membrane material. However, because holes 159 are formed using a larger pin than that used to form holes 158, the elastic closing force $F_{58}$ that pinches closed hole 158 is larger than the elastic closing force $F_{59}$ pinching closed hole 159. Accordingly, as shown in FIG. 5(B), a relatively small pressure differential deforms membrane 155' and overcomes the elastic closing force $F_{59}$ to open pinhole 159', but does not overcome the elastic closing force $F_{58}$ holding closed pinhole 158, thereby producing a relatively low fluid flow through deformed membrane 155'. As shown in FIG. 5(C), when a relatively large pressure differential is applied across membrane 155" that overcomes both elastic closing forces $F_{58}$ and $F_{59}$, both pinholes 158" and 159" open to producing a relatively high fluid flow through deformed membrane 155".

The present invention will now be described with reference to cleaning certain specific flow control elements, each of which includes a wall section and elastic membrane formed according to the generalized flow control element described above.

Figure 6:
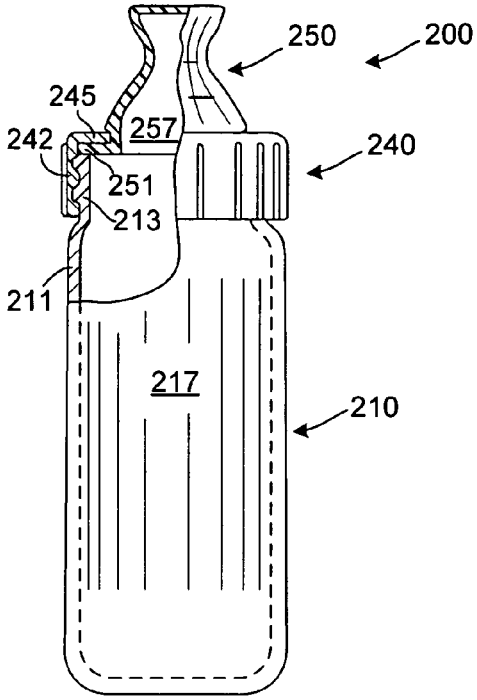
FIG. 6 is a partial cut-away side view showing a baby bottle assembly utilizing a nipple that is cleaned according to an exemplary embodiment of the present invention.

FIG. 6 is a partial cut-away side view showing a baby bottle assembly 200 including a nipple (flow control element) 250. Baby bottle assembly 200 generally includes a substantially cylindrical bottle body 210 and a ring-shaped cap 240 for securing nipple 250 to bottle body 210. Bottle body 210 has a roughly cylindrical wall 211 and threaded upper neck 213 that define a beverage storage chamber 217 for storing a fluid beverage (i.e., infant formula or milk). Cap 240 includes a cylindrical base portion 242 having threaded inside surface, and a disk-shaped upper portion 245 defining a central opening through which a portion of nipple 250 extends. When cap 240 is connected (screwed) onto bottle body 210, the threads formed on cylindrical base portion 242 mate with threaded neck 213. Bottle body 210 and cap 240 are molded from a suitable plastic using known methods.

Figure 7:
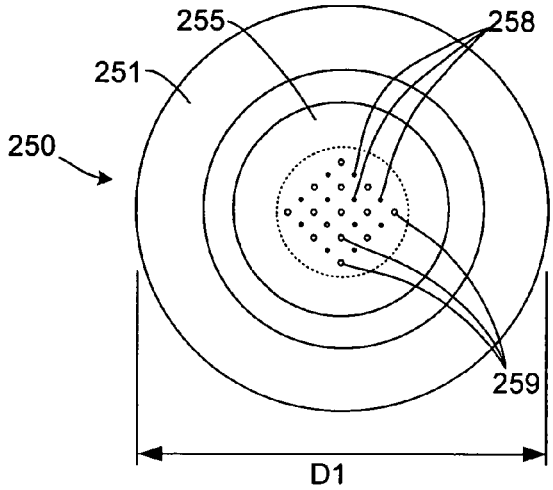
FIG. 7 is a top plan view of the nipple shown in FIG. 6.
Figure 8A:
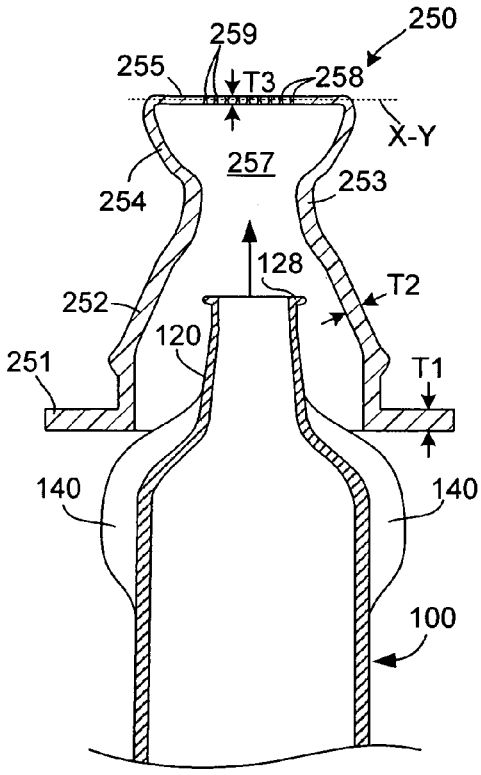
FIGS. 8(A) and 8(B) are cross-sectional side views showing the nipple of FIG. 6 during a cleaning process using the cleaning member of FIGS. 1(A) and 1(B)

Referring to FIGS. 7 and 8(A), nipple 250 includes a lower disk-shaped flange 251, a lower conical wall section 252 extending upward from flange 251, a neck region 253 formed above lower conical wall section 252, an upper conical wall section 254 extending upward from neck region 253, and a substantially flat, disk-shaped upper membrane 255 located at the upper portion of upper conical wall section 254. Lower conical wall section 252, neck region 253, upper conical region 254, and membrane 255 define an interior chamber 257. As indicted in FIG. 6, when mounted in bottle assembly 200, a ring-shaped portion of flange 251 is pinched between an upper edge of neck 213 and a portion of upper portion 245 of cap 240, and interior chamber 257 of nipple 250 communicates with storage chamber 217 of bottle body 210. Lower conical wall section 252 extends through the opening defined in disk-shaped upper portion 245 of cap 240, and gradually tapers from a relatively wide diameter near flange 251 to a relatively narrow diameter at neck region 253. Above neck region 253, upper conical wall section 254 again widens to a third, relatively wide diameter, which corresponds with the diameter of disk-shaped upper membrane 255. Flange 251 and conical sections 252 and 254 are formed using relatively thick sections of the elastomeric material, in comparison to membrane 255, which is relatively thin. In one embodiment, nipple 250 is molded as a single integral piece using silicone. In this embodiment, flange 251 has a thickness T1 of approximately 0.1 inches and a base diameter D1 of approximately 2 inches, lower conical wall section 154 has a thickness T2 of approximately 0.06 inches, and membrane 155 has a diameter of approximately 0.75 inches and thickness of approximately 0.02 inches.

Figure 8B:
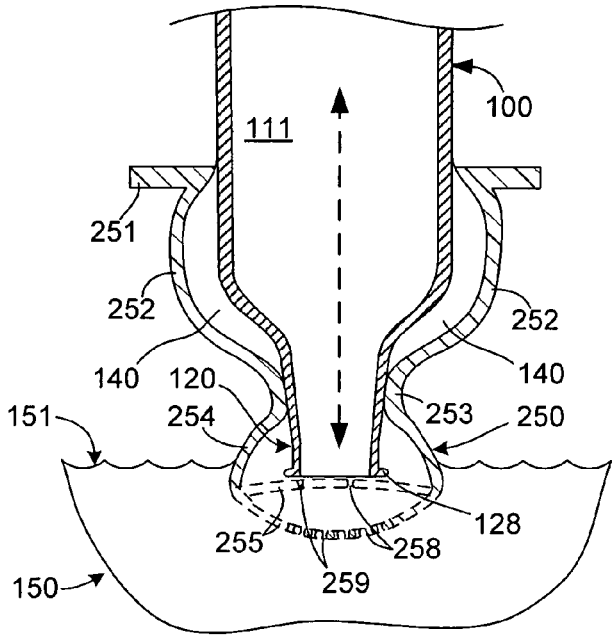

As indicated in FIGS. 8(A) and 8(B), during a cleaning process utilizing cleaning apparatus 100 (discussed above) tapered fixture 120 of cleaning apparatus 100 is inserted into cavity 257 until lip 128 is located adjacent to membrane 255 and longitudinal ribs 140 press against the inside surface of lower conical section 252. Subsequent pumping of cleaning solution 150 against membrane 255 generates a pressure differential such that a relatively high pressure becomes greater than a relatively low pressure outside membrane 255, thereby causing membrane 255 to stretch (bow) out of plane X-Y in the manner described above, thereby opening at least some of pinholes 258 and 259 to facilitate cleaning. In accordance with another aspect of the invention, as depicted by the dashed arrow in FIG. 8(B), the cleaning process involves holding membrane 255 below a surface 151 of cleaning solution 150, and manipulating the pump mechanism (not shown) to generate a two-way flow of cleaning solution through flow channel 111 and tapered fixture 120, thus causing membrane 255 to alternately bend away from and toward cleaning apparatus 100.

Figure 9:
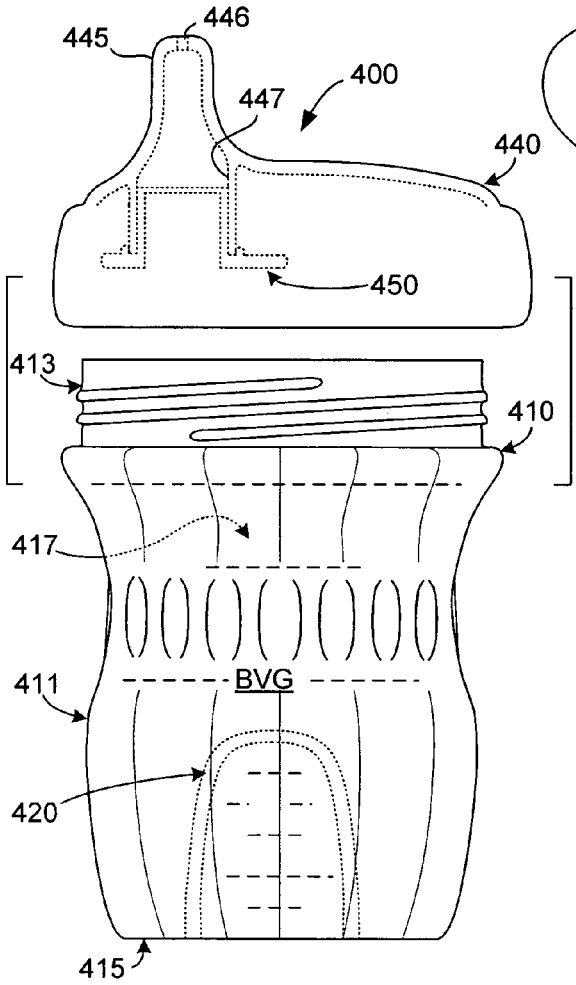
FIG. 9 is a side view showing a sippy cup including a flow control element that is cleaned according to another exemplary embodiment of the present invention.

FIG. 9 is a side view showing a sippy cup 400 that utilizes a flow control element 450 formed in accordance with another specific embodiment of the present invention. Sippy cup 400 generally includes a hollow cup-shaped body 410, and a cap 440 having flow control element 450 mounted thereon. Body 410 includes a roughly cylindrical sidewall 411 having a threaded upper edge 413, and a bottom wall 415 located at a lower edge of sidewall 411. Sidewall 411 and bottom wall 415 define a beverage storage chamber 417 in which a beverage BVG is received during use. An optional cold plug 420 is mounted on bottom wall 415, as described in co-owned U.S. Pat. No. 6,502,418 issued Jan. 7, 2003. Cap 440 includes a base portion 442 having threaded inside surface that mates with threaded upper edge 413 to connect cap 440 to body 410, thereby enclosing storage chamber 417. Cap 340 also includes a drinking spout 445 defining an outlet passage 446. Provided at a lower end of drinking spout 445 is a cylindrical mounting structure 447 to which flow control element 450 is press fitted. Cylindrical mounting structure 447 forms a flow channel through which liquid passes from storage chamber 417 to outlet passage 446.

Figure 10:
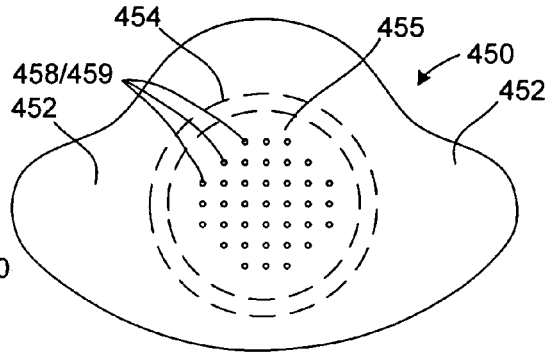
FIG. 10 is a plan view showing the flow control element utilized in the sippy cup of FIG. 9.
Figure 11:
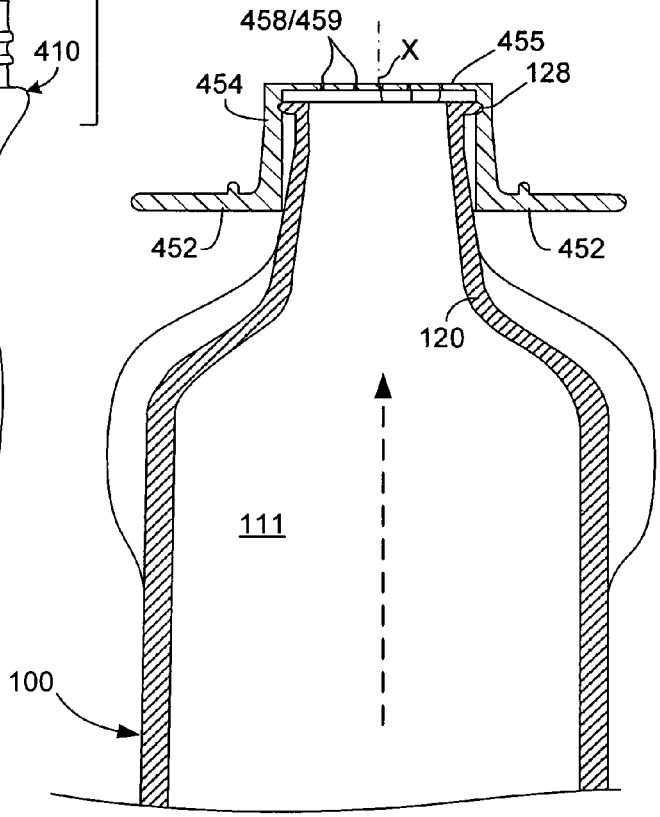
FIG. 11 is a cross-sectional side view showing the flow control element of FIG. 10 during a cleaning process using the cleaning member of FIGS. 1(A) and 1(B)

Referring to FIGS. 10 and 11, flow control element 450 is formed according to the generalized embodiment described above, and includes several peripheral pull-tabs 452, a cylindrical wall section 454 extending away from pull-tabs 452, and a membrane 455 extending across one end of cylindrical wall 454. Pull-taps 452 are formed by a flat, relatively thick section of the elastomeric material, and provide convenient handles for removing flow control element 450 from cap 440. Cylindrical wall 454 is also relatively thick, and defines a central axis X that extends substantially perpendicular to the plane defined by pull-tabs 452. In contrast, membrane 455 is relatively thin, and in the disclosed embodiment is located in the plane defined by pull-tabs 452. In accordance with the present invention, several pinholes 458 and 459 are formed in the manner described above with reference to pinholes 158 and 159 of the generalized embodiment to facilitate liquid flow from storage chamber 417 through drinking spout 445 in the manner described above.

As indicated in FIG. 11, during a cleaning process utilizing cleaning apparatus 100 (discussed above) tapered fixture 120 of cleaning apparatus 100 is inserted into flow control element 450 until lip 128 is located adjacent to membrane 455. Subsequent pumping of cleaning solution 150 against membrane 455 generates a pressure differential such that a relatively high pressure becomes greater than a relatively low pressure outside membrane 455, thereby causing membrane 455 to stretch (bow) outward in the manner described above, thereby opening at least some of pinholes 458 and 459 to facilitate cleaning.

Figure 12:
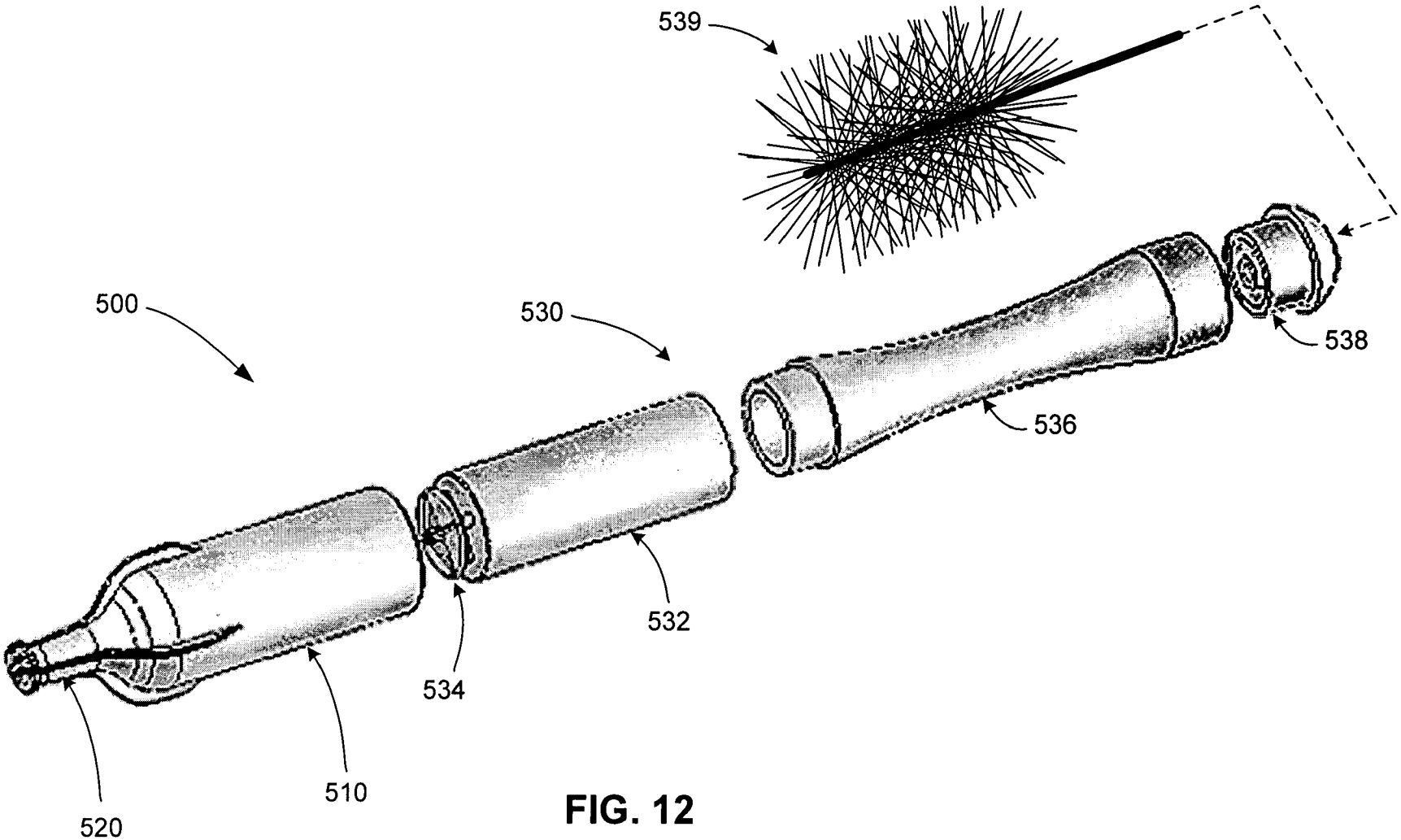
FIG. 12 is an exploded perspective view showing a cleaning apparatus including a plunger-type pump mechanism according to a specific embodiment of the present invention.
Figure 13:
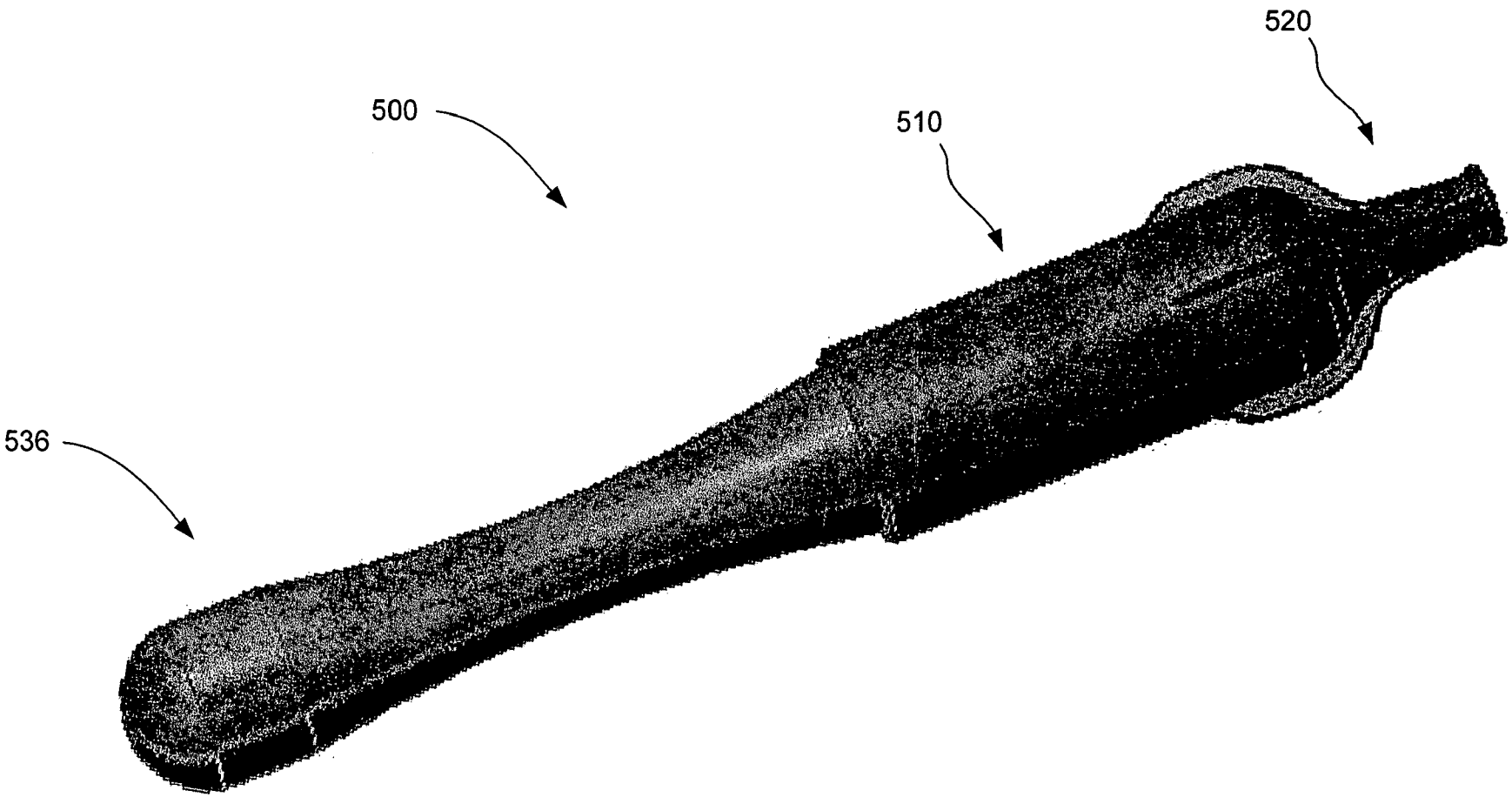
FIG. 13 is a perspective view showing the cleaning apparatus of FIG. 12 in an assembled state.

FIGS. 12 and 13 are exploded and assembled perspective views showing a cleaning apparatus 500 according to a specific embodiment of the present invention. Cleaning apparatus 500 includes a tubular flow member 510, a tapered fixture 520 integrally formed at a first end of tubular flow member 510, and a pump mechanism 530 mounted onto a second end of tubular flow member 510. In the present embodiment, pump mechanism 530 includes a shaft 532, a plunger 534 attached to a front end of shaft 532, and a handle 536 attached to a rear end of shaft 532, and an end plug 538 attached to a rear end of handle 536. An optional bottle brush and/or foam sponge 539 and/or 539 are provided on handle 536 by way of insertion into end plug 538. Raised ribs may be provided on the outside surface of tubular flow member 510 to aid a user's grip during manipulation. FIG. 13 shows cleaning apparatus 500 in an assembled state, with plunger 534 (FIG. 12) inserted into a flow channel (now shown) formed in tubular flow member 510. During use, plunger 534 is reciprocated inside the flow channel by manual operation of handle 536.

In addition to the general and specific embodiments disclosed herein, other features and aspects may be added to the novel flow control elements that fall within the spirit and scope of the present invention. Therefore, the invention is limited only by the following claims.

The invention claimed is:

1. An apparatus for cleaning a flow control element, the flow control element including a tube-like wall section defining a first flow channel, and an end section defining an outlet, the apparatus comprising:

a tubular flow member defining a second flow channel extending between a first end and a second end of the tubular flow member;

a tapered fixture fixedly attached to the tubular flow member at the first end of the flow channel, the tapered fixture being sized such that, when inserted inside the tube-like wall section, the tapered fixture becomes frictionally engaged to the inside surface of the tube-like wall section;

a pump mechanism, connected to the tubular flow member at the second end of the flow channel, for generating fluid flow in the tubular flow member such that the fluid flows through the tapered fixture and passes through the outlet;

a substantially cylindrical mounting structure fixedly connected at a fixed end to the first end of the tubular flow member, the mounting structure having a free end defining an opening; and an annular lip structure mounted on the free end of the mounting structure and surrounding the opening, wherein the tapered fixture further comprises a rail structure attached to the lip structure and extending over the opening.

2. An apparatus for cleaning a flow control element, the flow control element including a tube-like wall section defining a first flow channel, and an end section defining an outlet, the apparatus comprising:

a tubular flow member defining a second flow channel extending between a first end and a second end of the tubular flow member;

a tapered fixture fixedly attached to the tubular flow member at the first end of the flow channel, the tapered fixture being sized such that, when inserted inside the tube-like wall section, the tapered fixture becomes frictionally engaged to the inside surface of the tube-like wall section;

a pump mechanism, connected to the tubular flow member at the second end of the flow channel, for generating fluid flow in the tubular flow member such that the fluid flows through the tapered fixture and passes through the outlet;

a substantially cylindrical mounting structure fixedly connected at a fixed end to the first end of the tubular flow member, the mounting structure having a free end defining an opening; and an annular lip structure mounted on the free end of the mounting structure and surrounding the opening, wherein the tapered fixture further comprises a tapered neck section integrally extending between the second end of the tubular flow member and the mounting structure, the tapered neck region defining a relatively wide diameter adjacent to the first end of the tubular flow member, and a relatively narrow diameter adjacent to the mounting structure.

3. The apparatus according to claim 2, further comprising a longitudinal rib extending from an outer surface of the tapered fixture and extending in the direction of the second flow channel.

4. An apparatus for cleaning a flow control element, the flow control element including a tube-like wall section defining a first flow channel, and an end section defining an outlet, the apparatus comprising:

a tubular flow member defining a second flow channel extending between a first end and a second end of the tubular flow member;

a tapered fixture fixedly attached to the tubular flow member at the first end of the flow channel, the tapered fixture being sized such that, when inserted inside the tube-like wall section, the tapered fixture becomes frictionally engaged to the inside surface of the tube-like wall section; and a pump mechanism, connected to the tubular flow member at the second end of the flow channel, for generating fluid flow in the tubular flow member such that the fluid flows through the tapered fixture and passes through the outlet, wherein outlet of the flow control element comprises a membrane formed from an elastomeric material that defines multiple, substantially round pinholes that remain closed to prevent fluid flow through the membrane and flow channel under normal atmospheric conditions, and open to facilitate fluid flow rate through the membrane when subjected to an applied pressure differential, and wherein the pump mechanism comprises means for forcing liquid through the pinholes both in a first direction that causes the membrane to bend away from the first flow channel, and in a second direction that causes the membrane to bend into the first flow channel.

5. The apparatus according to claim 4, wherein the pump mechanism comprises a shaft, a plunger received inside the second flow channel and attached to a first end of the shaft, and a handle attached to a second end of the shaft.

6. The apparatus according to claim 4, wherein the pump mechanism further comprises at least one of a brush and a sponge mounted on the handle.

* * * * *

UNITED STATES PATENT AND TRADEMARK OFFICE

CERTIFICATE OF CORRECTION

PATENT NO. : 7,591,273 B2
APPLICATION NO. : 11/131753
DATED : September 22, 2009
INVENTOR(S) : James W. Holley, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1163 days.

Signed and Sealed this

Twenty-first Day of September, 2010

David J. Kappos

David J. Kappos
*Director of the United States Patent and Trademark Office*